US008382557B2

(12) United States Patent
Wu et al.

(10) Patent No.: US 8,382,557 B2
(45) Date of Patent: Feb. 26, 2013

(54) CHEMICAL MECHANICAL PLANARIZATION PAD CONDITIONER AND METHODS OF FORMING THEREOF

(75) Inventors: Jianhui Wu, Worcester, MA (US); Richard W. Hall, Southborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 1139 days.

(21) Appl. No.: 12/257,264

(22) Filed: Oct. 23, 2008

(65) Prior Publication Data

US 2012/0115402 A1 May 10, 2012

Related U.S. Application Data

(60) Provisional application No. 60/987,964, filed on Nov. 14, 2007.

(51) Int. Cl.
*B24B 53/12* (2006.01)

(52) U.S. Cl. ..... 451/443; 451/56

(58) Field of Classification Search ..... 451/443, 451/444, 56; 427/256, 249.1, 249.9; 977/742
See application file for complete search history.

(56) References Cited

U.S. PATENT DOCUMENTS

| | | | | |
|---|---|---|---|---|
| 6,054,183 | A | 4/2000 | Zimmer et al. | |
| 6,368,198 | B1 * | 4/2002 | Sung et al. | 451/443 |
| 6,632,127 | B1 | 10/2003 | Zimmer et al. | |
| 6,818,029 | B2 | 11/2004 | Myoung et al. | |
| 6,852,016 | B2 * | 2/2005 | Henderson | 451/56 |
| 6,872,127 | B2 | 3/2005 | Lin et al. | |
| 7,097,906 | B2 | 8/2006 | Gardner | |
| 7,189,333 | B2 | 3/2007 | Henderson | |
| 7,771,498 | B2 * | 8/2010 | Sung | 51/295 |
| 2003/0109204 | A1 | 6/2003 | Sung | |
| 2004/0053567 | A1 | 3/2004 | Henderson | |
| 2006/0063005 | A1 | 3/2006 | Gardner | |

FOREIGN PATENT DOCUMENTS

| | | |
|---|---|---|
| JP | 2004-050364 A | 2/2004 |
| JP | 2007-152493 A | 6/2007 |
| WO | 2005/078162 | 8/2005 |

OTHER PUBLICATIONS

A. Hart., et al., "Force Output, Control of Film Structure, and Microscale Shape Transfer by Carbon Nanotube Growth under Mechanical Pressure," Nano Letters, vol. 6, No. 6, pp. 1254-1260, 2006.

(Continued)

*Primary Examiner* — Dung V Nguyen
(74) *Attorney, Agent, or Firm* — Abel Law Group, LLP; Joseph P. Sullivan

(57) ABSTRACT

A CMP pad conditioner is provided that includes a substrate having a surface and three dimensional structures protruding relative to the surface of the substrate. The three dimensional structures include CVD carbon-containing material selected from the group consisting of carbon nanotubes and diamond, and may be arranged in a ordered array or desired pattern. The CMP pad conditioner also includes a bonding layer overlying the three dimensional structures and the surface of the substrate. The condition may include a reinforcing layer disposed within gaps between the three dimensional structures. Techniques for manufacture and use are also disclosed.

20 Claims, 4 Drawing Sheets

OTHER PUBLICATIONS

M. Schmidbauer et al., "Controlling Planar and Vertical Ordering in Three-Dimensional (In, Ga)AS Quantum Dot Lattices by GaAS Surface Orientation," Physical Review Letters, PRL 96, 066108, pp. 066108-1 thru 066108-4, 2006.

Highlights in Recent Literature, Editor's Choice "A string of dots," from Applied Physics Letters, vol. 84, 2004, Science, vol. 303, 2004.

A. Hart, et al., "Uniform and Selective CVD Growth of Carbon Nanotubes and Nanofibres on Arbitrarily Microstructured Silicon Surfaces," Nanotechnology, vol. 17, pp. 1397-1403, 2006.

E. Garcia, et al., "Fabrication of Composite Microstructures by Capillarity-driven Wetting of Aligned Carbon Nanotubes with Polymers," Nanotechnology, vol. 18, pp. 1-11, 2007.

* cited by examiner

CHEMICAL MECHANICAL PLANARIZATION PAD CONDITIONER AND METHODS OF FORMING THEREOF

CROSS-REFERENCE TO RELATED APPLICATION(S)

The present application claims priority from U.S. Provisional Patent Application No. 60/987,964, filed Nov. 14, 2007, entitled "A CHEMICAL MECHANICAL PLANARIZATION PAD CONDITIONER AND METHODS OF FORMING THEREOF," naming inventors Jianhui Wu and Richard W. Hall, which application is incorporated by reference herein in its entirety.

BACKGROUND

1. Field of the Disclosure

The present disclosure is related to chemical mechanical planarization pad conditioners, and more particularly CMP pad conditioners incorporating particularly hard, carbon-containing materials.

2. Description of the Related Art

In the fabrication of integrated circuits and other electronic devices, multiple layers of conducting, semiconducting, and dielectric materials are deposited onto and removed from a surface of a semiconductor wafer. As layers of materials are sequentially deposited and removed, the uppermost surface of the wafer becomes non-planar. Because subsequent semiconductor processing requires the wafer to have a flat surface, the wafer needs to be planarized. A wafer surface that is not sufficiently planar will result in structures that are poorly defined, with the circuits being nonfunctional or exhibiting less than optimum performance. Chemical mechanical planarization (CMP) is a common technique used to planarize or polish workpieces such as semiconductor wafers.

During a typical CMP process a workpiece is placed in contact with a polishing pad and a polishing slurry is provided on the pad to aid in the planarization process. The polishing slurry can include abrasive particles which may interact with the workpiece in an abrasive manner to remove materials, and may also act in a chemical manner to improve the removal of certain portions of the workpiece. The polishing pad is typically much larger than the workpiece. The polishing surface of the pad is generally a polymer material that can include certain features, such as micro-texture suitable for holding the slurry on the surface of the pad. Moreover, during a polishing operation, a pad conditioner is typically employed to move over the surface of the polishing pad to clean the polishing pad and properly condition the surface to hold slurry.

Polishing pad conditioning is important to maintaining a desirable polishing surface for consistent polishing performance, because over time the polishing surface of the polishing pad wears down, smoothing over the micro-texture of the polishing surface. Additionally, debris from the CMP process can clog the micro-channels through which slurry flows across the polishing surface. Conventional polishing pad conditioning is achieved by abrading the polishing surface mechanically with a pad conditioner, typically consisting of diamonds placed on the surface of a substrate. However, such conditioners typically suffer from several flaws, including among others, diamond pop-out, variable protrusion height of the diamonds above the surface of the substrate, uncontrolled diamond grain orientation, and variable diamond grit positioning.

Accordingly, the industry continues to demand improved CMP pad conditioners and methods of forming thereof.

SUMMARY

One embodiment provides a CMP pad conditioner. The conditioner includes a substrate having a surface, and three dimensional structures protruding relative to the surface of the substrate. Each three dimensional structure comprises a CVD carbon-containing material selected from the group consisting of carbon nanotubes and diamond. A bonding layer is overlying the three dimensional structures and the surface of the substrate. In one such case, the three dimensional structures consist essentially of carbon nanotubes. The carbon nanotubes may have an average width, for example, of not greater than about 100 nm, although numerous configurations will be apparent in light of this disclosure. In another particular case, the three dimensional structures comprise CVD diamond, more particularly polycrystalline diamond having an average crystallite size within a range between about 10 nm and about 10 microns. In another particular embodiment, the crystallite size is less than about 1 micron. The three dimensional structures may be arranged in an ordered array (e.g., pattern, such as a SARD™ pattern). In one such case, the ordered array includes not less than about 1 three dimensional structure/mm2 and a spacing distance between the three dimensional structures of not greater than about 2 mm. The three dimensional structures may have, for example, a generally polygonal contour or other suitable shape. For instance, the three dimensional structures could be one of: a cubic shape including a height>width (e.g., wherein the width is not less than about 1 micron); a cylindrical contour including a height>diameter (e.g., wherein the diameter is not less than about 1 micron); and a pyramidal contour including a height>base width (e.g., wherein the base width is not less than about 1 micron). In one particular configuration, the bonding layer infiltrates the three dimensional structures to an average infiltration depth of not less than about 10 nm, and comprises a material having a Mohs hardness not less than about 7 and that is selected from the group of materials consisting of oxides, nitrides, borides, carbides, alumina, zirconia, silicon nitride, silicon carbide, tungsten carbide, cubic boron nitride, diamond, carbon, and diamond-like-carbon, and any combination thereof. The CMP pad conditioner may include a reinforcing layer disposed within gaps between the three dimensional structures. The CMP pad conditioner may include a buffer layer disposed between the substrate and the three dimensional structures. In one such case, the buffer is compositionally graded to accommodate differences in lattice constants between the substrate and the three dimensional structures. In another particular case, the three dimensional structures are formed at nucleation sites associated with intentionally created strain points. In one such example case, the CMP pad conditioner includes a buffer layer disposed between the substrate and the three dimensional structure. The buffer is compositionally graded to accommodate differences in lattice constants between the substrate and the three dimensional structures, and the three dimensional structures are formed at intentionally created strain points on the buffer. Numerous configurations will be apparent in light of this disclosure.

Another embodiment provides a CMP pad conditioner including a substrate having a surface and three dimensional structures protruding relative to the surface of the substrate, each three dimensional structure comprising a carbon-containing material having a hardness of at least approximately 15 GPa. The CMP pad conditioner further includes a bonding layer overlying the three dimensional structures and the surface of the substrate.

Another embodiment provides a method of forming a CMP pad conditioner. The method includes providing a substrate having a surface, and selectively depositing three dimensional structures using a thin-film deposition technique, each of the three dimensional structures comprising a carbon-containing material selected from the group consisting of carbon nanotubes and diamond and wherein the three dimensional structures are protruding relative to the surface of the substrate. The method continues with forming a bonding layer overlying the three dimensional structures and the surface of the substrate. In one such case, forming the three dimensional structures includes forming an array of three dimensional structures. Here, forming the three dimensional structures may include forming a catalyst layer overlying the surface of the substrate, patterning the catalyst layer, and removing portions of the catalyst layer to leave an array of catalyst layer portions. Forming an array of three dimensional structures may further include depositing carbon over at least portions of catalyst layer. The method may include forming a reinforcing layer disposed between the three dimensional structures. In another case, forming the array of three dimensional structures may further include forming a buffer layer overlying the substrate, and growing three dimensional structures overlying the buffer layer. In one such case, the buffer is compositionally graded to accommodate differences in lattice constants between the substrate and the three dimensional structures. Forming three dimensional structures may include intentionally creating strain points as nucleation sites.

Another embodiment includes a CMP pad conditioner including a substrate having a surface and three dimensional structures comprising polycrystalline diamond protruding relative to the surface of the substrate. The CMP pad conditioner further includes a bonding layer overlying the three dimensional structures and the surface of the substrate. In another embodiment, the CMP pad conditioner includes polycrystalline diamonds comprising crystals having an average crystal size within a range between about 10 nm and about 10 microns. The three dimensional structures are discrete structures separate and spaced apart from each other having essentially the same polygonal shape and size, and wherein the three dimensional structures are arranged in an ordered array relative to each other, the ordered array comprising consistent spacing of the three dimensional structures.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

Figure 1:
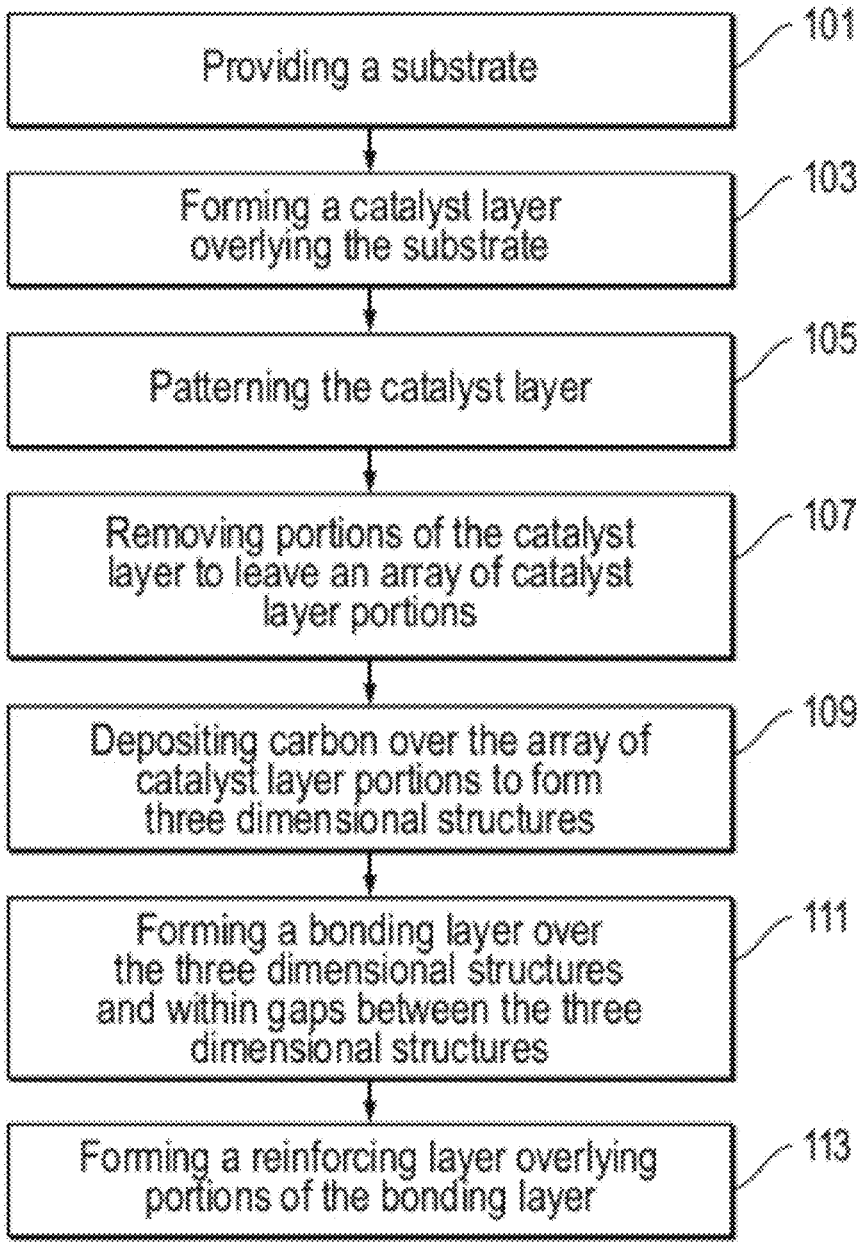
FIG. 1 includes a flow chart illustrating a process of forming a CMP pad conditioner in accordance with one embodiment.

FIG. 1 provides a flow chart illustrating a method of making a CMP pad conditioner in accordance with one embodiment. The flow chart describes a conditioner fabrication process that partially makes use of catalyst-assisted growth techniques for forming abrasive features on a substrate.

The process is initiated by providing substrate at step 101. The substrate is a workpiece suitable for forming additional layers and structures thereon to facilitate the final formation of a conditioner. The substrate material can include metals, metal alloys, ceramics, or any combination thereof. For example, suitable metals for the substrate can include steel, tungsten, copper, nickel, aluminum, or any alloy thereof. Suitable ceramic substrate materials can include inorganic compounds such as oxides, borides, nitrides, carbides, and the like. In one particular embodiment, the substrate is selected from a group of inorganic compounds including zirconia, silicon carbide, alumina, silicon nitride, chromium nitride, or any combination thereof. While typically the substrate includes a polycrystalline material, it will be appreciated that in some applications a monocrystalline substrate material may be used, including for example, a silicon wafer.

While the contour of the substrate can have a generally polygonal shape, typically the substrate has a circular shape, such as in the form of a disk, having a diameter and a thickness suitable for use with CMP machines as used in the industry. In some embodiments, the diameter (or length) of the substrate is within a range between about 5 cm and about 50 cm, and its thickness can range, for example, from 1 mm to about 20 mm. Numerous substrate shapes and dimensions will be apparent in light of this disclosure.

After providing a suitable substrate, the process continues at step 103 by forming a catalyst layer overlying the substrate. In particular, the catalyst layer can be formed on a major surface of the substrate in preparation for formation of three dimensional structures. The catalyst layer can be formed, for example, by a thin film formation technique including a deposition process. Suitable thin film deposition processes can include vapor deposition techniques such as chemical vapor deposition (CVD). According to one embodiment, the catalyst layer is formed by an electron beam evaporation or electron beam physical vapor deposition (EBPVD).

Alternatively, the catalyst layer can be formed by a coating technique, particularly when using a catalyst material in a liquid phase. For example, in one embodiment, the catalyst material can be in the form of a colloid, having particles of the catalyst material in suspension with a liquid carrier. According to one particular such embodiment, the catalyst layer is formed by utilizing a colloid having nano-sized catalyst particles in suspension and coating the surface of the substrate using the colloid. After the coating process, some drying or thermal treatment can be undertaken to remove the liquid carrier, and leave only the nano-sized catalyst material.

The catalyst layer can include inorganic materials, such as ceramics, metals, metal alloys, or any combination thereof. Some suitable metals can include transition metals, particularly iron, nickel, cobalt, or any combination thereof. In some embodiments, metals can be combined with other materials to form inorganic compounds, such as oxides, carbide, nitrides, or borides. In one particular embodiment, the catalyst layer can include an oxide. In another particular such embodiment, the catalyst layer includes aluminum and oxygen, such as in the form of aluminum oxide, or a compound or complex oxide material including aluminum.

Various embodiments will be apparent in light of this disclosure. For instance, and with respect to catalyst layers formed by thin film formation techniques, the catalyst layer can include a plurality of films, particularly conformal and continuous films of material coating the surface of the substrate. Each of these films can include a metal, metal alloy, inorganic compound, or any combination thereof. In one embodiment, the catalyst layer includes a first film grown directly on the surface of the substrate and includes an inorganic compound, particularly an oxide, such as aluminum oxide. In this embodiment, a second film is formed overlying and directly in contact with the first film. The second film can include a metal, or metal alloy, such as iron, cobalt, or molybdenum. On the other hand, forming the catalyst layer by a coating technique can be most readily completed using inorganic materials suitable for forming colloids. Particularly suitable inorganic materials can include ceramics, metals, or metal alloys, or any combination thereof In one particular embodiment, a colloid is formed from a transition metal, such as cobalt using an aqueous-based carrier.

In some embodiments, the catalyst layer has a thickness within a range from about 0.1 nm to about 500 nm, or even more specifically, within a range between about 0.5 nm to about 50 nm, or even more specifically, within a range between about 1 nm and about 25 nm. For instance, the catalyst layer may be about 30 nm or less, or about 20 nm or less, or about 10 nm or less. In one particular embodiment that utilizes a catalyst layer including a plurality of films, each of the films has an average thickness of about 30 nm or less, or more particularly of about 20 nm or less. In general, the thickness of the catalyst layer will depend on a number of factors, such as the materials making up the layer and the formation technique. Numerous catalyst layer configurations will be apparent in light of this disclosure.

After forming the catalyst layer at step 103, the process can continue by patterning the catalyst layer at step 105. In one embodiment, patterning of the catalyst layer can include the removal of portions of the catalyst layer via a physical process (e.g., laser ablation). Alternatively, patterning can be completed by the addition of a mask overlying the catalyst layer and subsequent patterning of the mask. Patterning of an overlying masking layer can be achieved by a chemical process (e.g., an etching process or an exposure and development process) to expose certain portions of the underlying catalyst. In one particular such embodiment, patterning of the catalyst layer includes the formation of an organic-based photoresist layer overlying the catalyst layer. Portions of the photoresist layer are then exposed to radiation resulting in a pattern which is later developed by a photolithography process.

After patterning the catalyst layer at step 105, portions of the catalyst layer can be removed to leave an array of catalyst layer portions at step 107. As will be appreciated, a suitable removal process can be used in conjunction with a particular patterning process. For example, an etching process can be undertaken to selectively remove portions of the catalyst layer in embodiments utilizing a hard mask. After which, the remaining portions of the mask can be removed. Alternatively, in embodiments utilizing a photolithography process, after exposing portions of the catalyst layer to select radiation, portions of the catalyst layer can be developed and removed along with the portions of the mask. Such a development process can include the use of thermal treatment in combination with a particular chemical developer. It will be further appreciated, that depending upon the nature of the radiation and type of photoresist mask, portions exposed to the radiation can be developed and removed, or alternatively, those portions not exposed to the radiation can be developed and removed.

Formation of the array of catalyst layer portions facilitates the formation of three dimensional structures grown from these portions and overlying this array, and thus the array of catalyst layer portions facilitates the arrangement of a final formed array of three dimensional structures. Accordingly, the array of catalyst layer portions can include a plurality of isolated layer portions, including layer portions having certain polygonal contours, such as rectangular, circular, triangular, or other desirable shapes.

After forming the array of catalyst layer portions at step 107, the process continues at step 109 by selectively depositing or otherwise forming three dimensional structures the array of catalyst layer portions. The three dimensional structures can be discrete structures protruding from the surface of the substrate, particularly separate and spaced apart from each other. In one embodiment, the three dimensional structures are formed via a thin-film forming technique, including for example chemical vapor deposition (CVD). In one particular embodiment, the process includes selective deposition of a carbon-containing material selected from the group consisting of carbon nanotubes and diamond. In one such particular embodiment, the three dimensional structures are formed using a plasma enhanced chemical vapor deposition (PECVD).

In some embodiments, and depending on the formation process employed, the three dimensional structures can be formed in a high temperature environment, for example, at temperatures within the range of about 200° C. to about 1000° C., or even more specifically, within a range between about 400° C. to about 900° C., or even more specifically, within a range between about 600° C. to about 800° C. Numerous formation parameters including temperature will be apparent in light of this disclosure.

The environment during the formation of the three dimensional structures, particularly in the context of deposition processing, can include a gas source material. According to one embodiment, the formation of the structures including carbon nanotubes is completed using an organic gaseous source. In one particular embodiment, the gaseous source material includes carbon containing organic materials, such as for example C2H2, C2H4, or CH4, or any combination thereof. Moreover, other gases can be provided to the environment during the formation process, including for example a noble gas or an inert gas, including for example H2 or Ar.

Additionally, the formation of the three dimensional structures can be completed at atmospheric pressures. However, other embodiments may utilize a reduced pressure atmosphere.

Generally, and in accordance with one some embodiments, the three dimensional structures are grown vertically from the surface of the catalyst layer portions, and at a growth rate within a range between about 100 nm/min and about 500 microns/min, or even more specifically, within a range between about 500 nm/min and about 500 microns/min. Numerous growth techniques and parameters will be apparent in light of this disclosure.

In one embodiment, the three dimensional structures are made essentially of CVD diamond. In certain embodiments, the three dimensional structures comprising CVD diamond structures can include polycrystalline diamond. The polycrystalline diamond can include crystals having an average crystallite size within a range between about 10 nm and about 10 microns. More particularly, in certain embodiments, the crystallite size is less than about 1 micron.

In another embodiment, the three dimensional structures are made essentially of CVD carbon nanotubes. In particular reference to the carbon nanotubes (CNTs), such structures can also include carbon nanofibers (CNFs). Moreover, the CNTs have varying structures, such as multi-walled carbon nanotubes (MWCNTs) or single-walled carbon nanotubes (SWCNTs). In one particular embodiment, each of the individual CNTs has an average diameter within the range of about 1 nm to about 100 nm. Other embodiments can utilize CNTs having a smaller average diameter, such as not greater than about 50 nm, or not greater than about 25 nm, or even not greater than about 10 nm.

While it will be appreciated that carbon nanotubes can be formed in a tangled web, aligned filaments, bundles, ropes, or crystals, generally, the three dimensional structures include CNTs having some order. The three dimensional structures can include a web of CNTs grown in aligned configuration, extending in a substantially vertical direction from the surface of the substrate.

The three dimensional structures typically have a volume fraction of CNTs of not less than about 0.7. Other embodiments may utilize more dense three dimensional structures, such that the volume fraction of CNTs is not less than about 0.8, or even not less than about 0.9. Void space within the three dimensional structure may be controlled to facilitate impregnation of an overlying bonding layer as described herein.

Alternatively, the three dimensional structures can include a composite material. According to one embodiment, the three dimensional structures include an inorganic material combined with the CNTs. Suitable inorganic materials can include single crystal or polycrystalline materials. Suitable inorganic materials can be compounds or complex materials including for example oxygen, nitrogen, silicon, aluminum, boron, and other forms of carbon. For example, in one particular embodiment, the three dimensional structures include a diamond-carbon nanotube composite, such as CNTs combined with ultrananocrystalline diamond.

According to another aspect, the three dimensional structures can include a carbon-containing material having a hardness of at least about 15 GPa. In certain embodiments, the hardness can be greater, such as at least about 25 GPa, or at least 50 GPa, or even at least about 100 GPa. According to one particular embodiment, the three dimensional structures include a carbon-containing material having a hardness within a range between about 15 GPa and about 300 GPa.

Thus, upon completion of step 109, an array of three dimensional structures extending from the surface of the substrate is formed. The array can be constructed to have certain features. In one embodiment, the array includes a random arrangement of the three dimensional structures across the surface of the substrate. Still, in another embodiment, the array includes an ordered array or pattern of the structures having some long range order. In one embodiment, the three dimensional structures are formed in a regular and repeating pattern across the surface of the substrate. In one embodiment, the three dimensional structures have essentially the same polygonal shape and size and arranged in an ordered array relative to each other, the ordered array comprising consistent spacing of the three dimensional structures. In another embodiment, the three dimensional structures are formed in a self-avoiding random distribution (SARD™), as described in U.S. Patent Application Publication No. 2006/0010780, titled "Abrasive Tools Made with a Self-Avoiding Abrasive Grain Array".

Moreover, the three dimensional structures can be formed to have certain polygonal contours. Particularly suitable polygonal shapes include cubic, cylindrical, pyramidal, or any combination thereof. Accordingly, such polygonal structures have cross-sectional contours parallel to the surface of the substrate that are generally polygonal, for example rectangular (including square), circular, or triangular. The array of three dimensional structures can include an array including a single structure, such as only cubic structures. Alternatively, the array can include a combination of structures such as cubic, cylindrical, and pyramidal structures, arranged in a strategic array over the surface of the substrate. Still other embodiments may include three dimensional structures having other shapes, such as half-moons, crosses, asterisks, or waves (e.g., s-curves). Irregular shapes may also be used (e.g., asymmetrical shapes). In general, the three dimensional structures can have any shapes that can be formed or otherwise manufactured with suitable processes.

The three dimensional structures, given certain shapes, have particular dimensions including height, and width, or diameter. Generally, the height of the three dimensional structures is the dimension of the structure extending from the base nearest the surface of the substrate to the top of the structure furthest away from the substrate. In one particular embodiment, the height is within the range of about 1 micron to about 1 mm, or even more specifically not less than about 100 microns, and even more specifically not less than about 300 microns, or even more specifically not less than about 500 microns.

In embodiments utilizing three dimensional structures having a cylindrical contour, the cross-section of such structures is a circle having a diameter measured parallel to the surface of the substrate through the center of the circle. In some such embodiments, the average diameter of cylindrical three dimensional structures is within a range from about 1 micron to about 1 mm, or even more specifically not less than about 20 microns, or even more specifically not less than about 50 microns, or even more specifically not less than about 100 microns. Notably, in some particular embodiments, an array can utilize more than one size of the cylindrical structures.

In embodiments utilizing three dimensional structures having a pyramidal contour, such structures generally have a triangular cross-section parallel to the surface of the substrate. In some such embodiments, the average base width measured as the length of a side nearest to the surface of the substrate is within a range from about 1 micron to 1 mm, or even more specifically not less than about 25 microns, or even more specifically not less than about 50 microns, or even more specifically not less than about 100 microns. As will be appreciated, in some particular embodiments, an array can utilize more than one size of pyramidal structures.

Some embodiments include three dimensional structures having a cubic shape including a base and five square or rectangular sides. Such structures generally have a cross-section parallel to the surface of the substrate that is rectangular or square. In some such embodiments, the average width the cubic structures, measured as a width of one side is within the range of about 1 micron to 1 mm, or even more specifically not less than about 25 microns, or even more specifically not less than about 50 microns, or even more specifically not less than about 100 microns. Again, in some particular embodiments, an array can utilize more than one size of rectangular structures.

After forming the array of the three dimensional structures at step 109, the process of forming the conditioner continues by forming a bonding layer overlying the array of three dimensional structures and within the gaps between those structures, at step 111. The formation of a bonding layer facilitates maintaining the structure of the array and physically adhering the three dimensional structures in place relative to the substrate and relative to each other. Moreover, the bonding layer can enhance the cleaning and conditioning capabilities of the conditioner by providing abrasive capabilities. In some embodiments, the formation of the bonding layer can include a thick film or thin film forming technique. For example, suitable thick film forming techniques can include sputtering or coating processes. In one particular such embodiment, the bonding layer is formed from a colloidal suspension of nano-sized abrasive particles.

Alternatively, the bonding layer can be formed by a thin film forming technique, including for example a deposition process. In one such embodiment, the bonding layer is formed by a chemical vapor deposition (CVD) process. In another embodiment, the bonding layer is formed by plasma enhanced chemical vapor deposition (PECVD).

Generally, the bonding layer includes a hard material suitable for abrading softer materials. In one example embodiment, the bonding layer includes a material having a Mohs hardness of not less than about 7. Other embodiments may utilize a harder material, such as a material having a Mohs hardness of not less than about 8, or even not less than about 9.

Suitable materials for incorporation into the bonding layer can include, for example, inorganic materials. Particularly suitable inorganic materials can include abrasive or superabrasive materials, which may include materials such as oxides, nitrides, borides, carbides, and any combination thereof. According to one embodiment, certain ceramic materials such as alumina, zirconia, silicon nitride, silicon carbide, tungsten carbide, cubic boron nitride, diamond, carbon, and diamond-like-carbon, can be included within the bonding layer.

During the formation of the bonding layer, the abrasive material can infiltrate the three dimensional structures. In accordance with one embodiment, the material of the bonding layer can impregnate or otherwise penetrate the three dimensional structure to an average infiltration depth within the range of about 10 nm to about 10 microns. According to other specific embodiments, the average infiltration depth can be not less than about 25 nm, or not less than about 50 nm, or even not less than about 75 nm.

Still referring to FIG. 1, after forming the bonding layer, the process can continue at step 113 by forming a reinforcing layer overlying the bonding layer. The reinforcing layer can include, for example, a layer of material filling the gaps between the three-dimensional structures suitable for providing mechanical support to the three dimensional structures and the bonding layer. The reinforcing layer may be initially formed as a conformal layer overlying the three dimensional structures and bonding layer. The reinforcing layer may then be exposed to a selective etch process to reduce the thickness of only the reinforcing layer such that after the etching process the reinforcing layer is filling the gaps between the three dimensional structures but not extending above the tops of the three dimensional structures and the overlying bonding layer. In some embodiments, the reinforcing layer is formed via liquid phase technology or gas phase technology. For example, suitable liquid phase forming techniques for making the reinforcing layer include plating, infiltration, and coating processes, or any combination thereof. According to one such embodiment, the reinforcing layer can be formed via a plating technique. The plating process can utilize an electrolytic process or an electroless process depending upon the material forming the reinforcing layer. For example, materials containing metals or metal alloys may be formed using an electrolytic plating process, while less conductive materials may be coated using an electroless process.

In one embodiment, reinforcing layer can be formed using an infiltration process. In one particular such embodiment, a soldering or brazing process can be completed to form the reinforcing layer. Such processes are well suited for a reinforcing layer containing a metal or metal alloy. Other infiltration techniques can include an immersion process wherein the surface of the workpiece is immersed in a particular material.

Alternative embodiments can utilize a coating process, including for example, printing, spin coating, roller coating, and spray coating, or any combination thereof. These processes may utilize elevated temperatures depending upon the material. According to one embodiment, the reinforcing layer is formed by spray coating the workpiece including the substrate, three dimensional structures, and bonding layer, with a colloidal suspension. In particular, the colloidal suspension can be a sol-gel incorporating a ceramic or glass material, which after application to the workpiece can be thermally treated.

Gas phase processes for forming the reinforcing layer can include thick film or thin film forming techniques. Particularly suitable thin film forming processes can include physical deposition techniques or vapor deposition techniques. Suitable physical deposition techniques can include sputtering and pulsed laser deposition. According to one embodiment, formation of the reinforcing layer includes a chemical vapor deposition process such as plasma enhanced chemical vapor deposition.

Generally, the reinforcing layer can include an organic or inorganic material. In one particular embodiment, certain inorganic materials can include metals, ceramics, glasses, and any combination thereof. Of the metal materials, the reinforcing layer can include a metal or metal alloy, particularly including transition metals. According to one embodiment, the reinforcing layer can include a metal such as copper, tungsten, aluminum, nickel, molybdenum, palladium, and any combination thereof. In alternative embodiments, ceramic or glass materials can form the reinforcing layer. Suitable ceramic materials can include oxides, nitrides, carbides, borides, and any combination thereof. A reinforcing layer including copper and tungsten may be particularly useful as a majority of electronic devices are formed having copper or tungsten components and incorporation of the same material in the pad conditioner would decrease the likelihood of contamination to the workpiece. The reinforcing layer can include organic materials, such as natural or synthetic materials, including for example, polymers, epoxies, resins, and acrylics. In one particular embodiment, suitable polymers include elastomers, thermosets, and thermoplastics. For example, one particularly suitable polymer is PMMA. In other embodiments, polyimides may also be used in the reinforcing layer.

Figure 2:
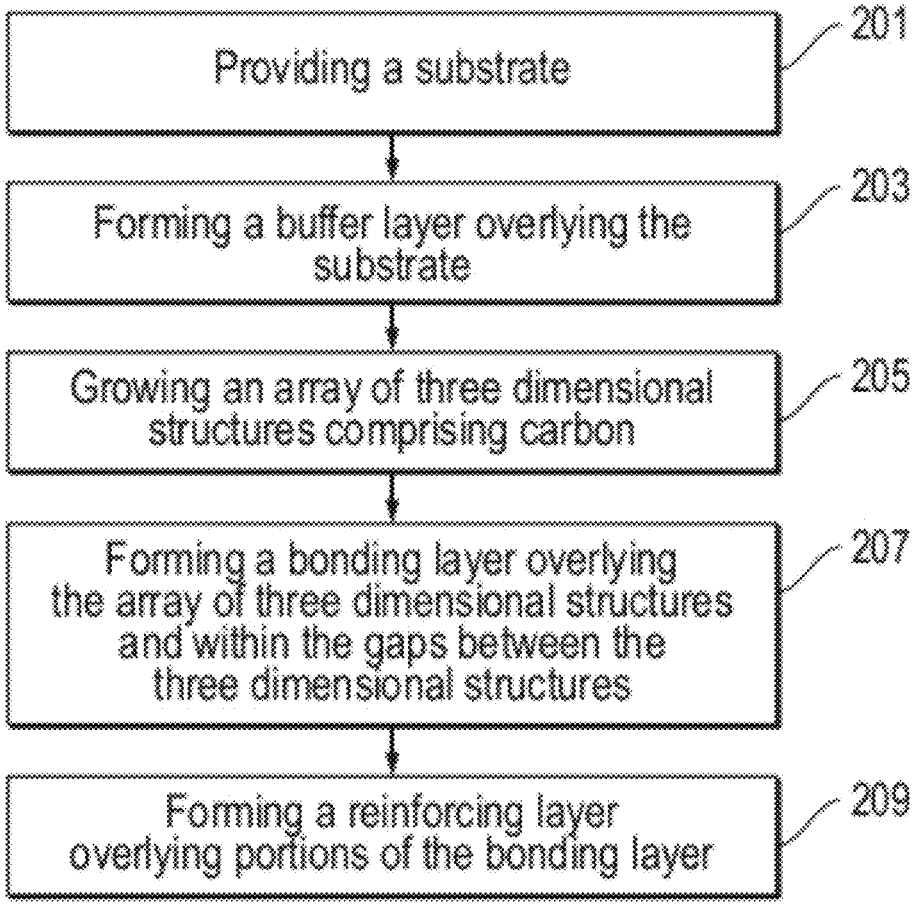
FIG. 2 includes a flow chart illustrating a process of forming a CMP pad conditioner in accordance with one embodiment.

Referring to FIG. 2, a process is illustrated for forming a CMP pad conditioner according to an alternative embodiment. As can be seen, this particular example embodiment provides a process that includes formation of a buffer layer and subsequent epitaxial growth of three dimensional structures to form a CMP pad conditioner. The process is initiated by providing a substrate at step 201. The substrate provides a workpiece for the subsequent formation of components thereon and can include those materials, dimensions, and characteristics as described previously in accordance with FIG. 1.

After providing the substrate at step 201, the process continues at step 203 by forming a buffer layer overlying the substrate. The buffer may be compositionally graded to accommodate differences in lattice constants between the substrate and the array of three dimensional structures. The buffer layer can be a substantially conformal coating having a generally uniform cross-sectional thickness and facilitating subsequent formation of three dimensional structures. In one particular embodiment, the buffer layer is formed such that it overlies substantially all of the surface of the substrate, however, in other embodiments it may cover a portion of the surface of the substrate.

In some embodiments, the buffer layer can be formed via a thin film formation technique, including for example, a growth process or a deposition process. According to one such embodiment, the buffer layer is formed via a growth process, such as epitaxy. One suitable epitaxial growth process includes molecular beam epitaxy. According to another such embodiment, the buffer layer can be formed via a deposition process, such as a chemical vapor deposition.

The average thickness of the buffer layer is, for example, within the range of about 1 nm to about 500 microns, or more specifically, not greater than about 250 microns, or more specifically, not greater than about 100 microns, or even more specifically, not greater than about 50 microns. Numerous buffer configurations will be apparent in light of this disclosure.

The buffer layer can include, for example, inorganic materials, such as a metal, metal alloy, ceramics, or any combination thereof. In particular, the buffer layer can include a ceramic compound, for example oxides, nitride, carbides, and borides. Moreover, the buffer layer can include particular elements and compounds containing particular elements, such as carbon and silicon. In one particular embodiment, the buffer layer includes carbon. Still, in another particular embodiment, the buffer layer includes titanium.

After the formation of the buffer layer, the process continues at step 205 with the growth of the three dimensional structures overlying the buffer layer. The growth process can include, for example, thin film growth process, such as epitaxy. According to one such embodiment, the three dimensional structures can be grown using the same growth process as is used to form the buffer layer. For example, the three dimensional structures can be formed via molecular beam epitaxy. In one particular embodiment, the three dimensional structures are formed by utilizing a strain-assisted growth mechanism or instability mechanism based upon intentional lattice mismatches between selected layers of material. In more detail, local strain energy is relatively higher at strain spots, compared with spots without any strain. The strained spots serve as preferred nucleation sites (i.e., growth will start with those strained spots). Thus, and in accordance with one particular embodiment, the formation of the three dimensional structures can be initiated by epitaxial growth of a layer of material, which when grown on top of the buffer layer has a particular lattice mismatch that results in the formation of discrete three dimensional structures. Recall that the buffer may be compositionally graded to provide a desired lattice constant at the growth points.

The three dimensional structures overlying the buffer layer can be formed, for example, of inorganic materials. Suitable inorganic materials include ceramics, including for example oxides, nitrides, borides, carbides, and any combination thereof. In one such embodiment, the three dimensional structures can include carbon, including various allotropes of carbon, for example diamond or fullerenes, or any combination thereof.

As previously discussed, the three dimensional structures grown according to step 205 can be formed in an array, or more particularly in a pattern having long range order. It will be appreciated that the three dimensional structures grown according to this embodiment can have the same patterns, dimensions, contours, and characteristics as the three dimensional structures described in the embodiments of FIG. 1.

After forming the three dimensional structures, the bonding layer can be formed at step 207 such that it overlies the three dimensional structures and within the gaps between the three dimensional structures. The bonding layer can be formed and have the same characteristics as the bonding layer previously described in embodiments of FIG. 1.

The reinforcing layer can be formed after the bonding layer at step 209, and can be formed using particular processes as previously discussed with reference to FIG. 1, including coating, spraying, deposition, or growth techniques. As will be apparent in light of this disclosure, the reinforcing layer is particularly suited for embodiments in which additional support of the three dimensional structures in advantageous beyond that provided by the bonding layer.

Figure 3:
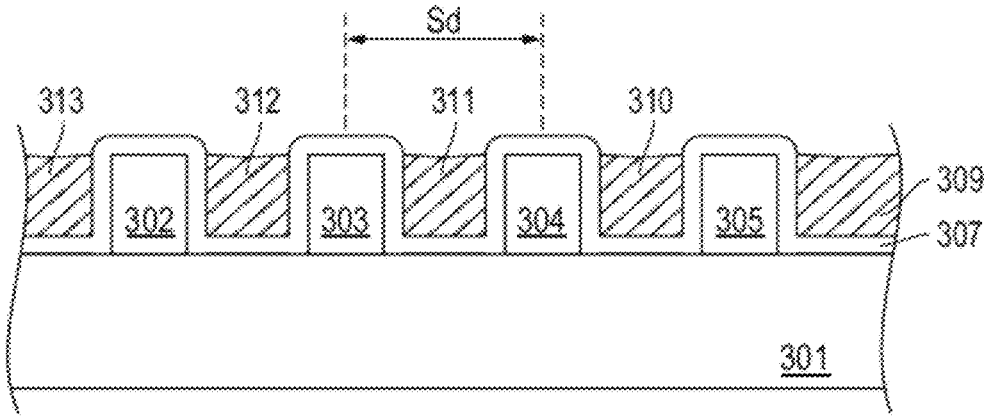
FIG. 3 includes a cross-sectional illustration of a portion of a CMP pad conditioner in accordance with one embodiment.

FIG. 3 includes a cross-sectional illustration of a portion of a CMP pad conditioner according to one embodiment. As illustrated, the conditioner includes a substrate 301 and three dimensional structures 302, 303, 304, and 305 (302-305) overlying and in direct contact with the substrate 301 (i.e., no buffer). FIG. 3 further illustrates a bonding layer 307 overlying the three dimensional structures 302-305 and the substrate 301, and a reinforcing layer 309, 310, 311, 312, and 313 (309-313) disposed within the gaps between the three dimensional structures 302-305 and overlying portions of the bonding layer 307.

The three dimensional structures 302-305 are individual structures, that is, substantially unconnected and discrete structures in contact with the substrate 301. Generally the three dimensional structures 302-305 are separated from each other by a spacing distance (Sd) measured from center-to-center in each structure as illustrated in FIG. 3. In some embodiments, the spacing distance between three dimensional structures 302-305 is within the range of about 10 microns to about 2 mm, or more specifically, not greater than about 500 microns, or even more specifically not greater than about 100 microns. In general, the spacing distance depends upon factors such as the size of the three dimensional structures 302-305, and can vary from one embodiment to the next.

The three dimensional structures 302-305 on the surface of the substrate 301 may be closely packed, such that the number of structures per area can describe a structure density on the surface of the substrate 301. In one embodiment, the array includes not less than about 1 three dimensional structure/mm2. According to another embodiment, the density of the structures within the array is not less than about 10 three dimensional structures/mm2. According to another embodiment, the density of structures within the array is within a range between about 1 and about 500 three dimensional structures/mm2. In still some other embodiments, the density of the structures within the array can be as high as about 1000 three dimensional structures/mm2, or higher if so desirable and feasible.

As illustrated in the example embodiment of FIG. 3, the bonding layer 307 is formed such that it is a substantially conformal coating over the surfaces of the three dimensional structures 302-305, having a generally uniform cross sectional thickness. In one embodiment, the bonding layer 307 has a thickness with the range of 1 micron to 250 microns and is formed to substantially maintain the polygonal contours of the underlying three dimensional structures 305. However, the average thickness of the bonding layer 307 can be even less, such as not greater than about 100 microns, or not greater than about 50 microns, or even not greater than about 10 microns.

According to the illustrated example embodiment of FIG. 3, the reinforcing layer 309-313 exists in the gaps between the three dimensional structures 302-305. In some embodiments, the thickness of the reinforcing layer 309 is within the range of about 5 microns and about 1 mm, or more specifically not greater than about 500 microns, or even more specifically not greater than about 250 microns, or even more specifically not greater than about 100 microns, or even more specifically not greater than about 50 microns, or even more specifically not greater than about 10 microns.

As previously mentioned, the reinforcing layer 309-313 can be formed such that it covers a certain amount of the available surface area around the three dimensional structures 301-305 and the overlying the bonding layer 307. In some embodiments, the reinforcing layer 309-313 covers at least about 50% of the available surface area around the three dimensional structures 301-305 and the bonding layer 307 such that the thickness of the reinforcing layer 309-313 is at least about half of the height of the three dimensional structures 301-305. In another example embodiment, the reinforcing layer 309-313 can cover more available surface area, such as at least about 75%, or at least about 80%, or even at least about 90% of the available surface area around the three dimensional structures 301-305 and bonding layer 307. With respect to the example embodiment shown in FIG. 3, the reinforcing layer 309-313 does not overlie the top surfaces of the bonding layer 307 and three dimensional structures 301-305.

Figure 4:
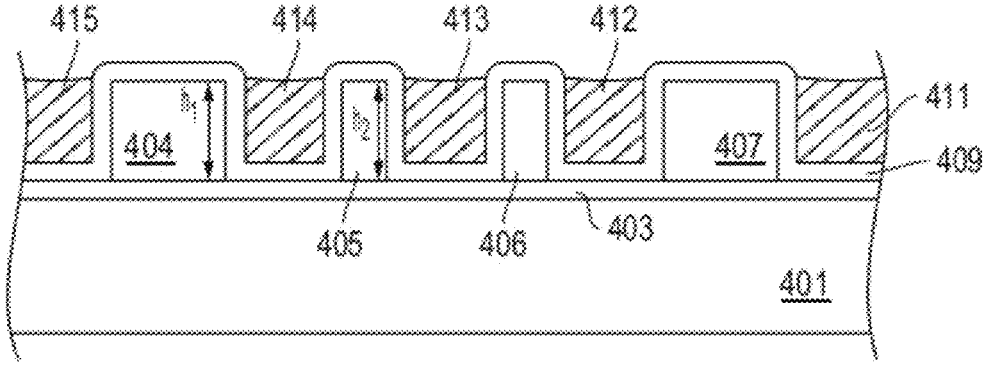
FIG. 4 includes a cross-sectional illustration of a portion of a CMP pad conditioner in accordance with one embodiment.

FIG. 4 includes a cross-sectional illustration of a portion of a CMP pad conditioner according to another embodiment. The pad conditioner of this example embodiment includes a substrate 401 and three dimensional structures 404, 405, 406 and 407 (404-407) overlying a buffer layer 403, which is overlying the substrate 401. The conditioner further includes a bonding layer 409 overlying the three dimensional structures 404-407, and reinforcing layer 411, 412, 413, 414, and 415 (411-415) that is disposed in the gaps between the three dimensional structures 404-407 and overlying portions of the three dimensional structures 404-407 and the bonding layer 409. In particular, the pad conditioner illustrated in FIG. 4 includes a buffer layer 403 in direct contact with the substrate 401, and the three dimensional structures 404-407 are in direct contact with the buffer layer 403.

As further provided, the pad conditioner illustrated in FIG. 4 includes differently shaped three dimensional structures 404-407. Notably, the three dimensional structures 404 and 407 have a substantially greater width than the three dimensional structures 405 and 406. Still, despite the presence of differently shaped three dimensional structures, the average height of the three dimensional structures, illustrated as h1 and h2, can be particularly controlled. As such, the finished conditioner with overlying layers (e.g., bonding layer 409 and the reinforcing layer 411) can have a particularly controlled surface planarity. Moreover, while the differently shaped three dimensional structures are illustrated as part of an embodiment using a buffer layer 403, differently shaped three dimensional structures 404-407 can be formed using any of the processes for forming a CMP pad conditioner provided herein, including bufferless embodiments.

Figure 5:
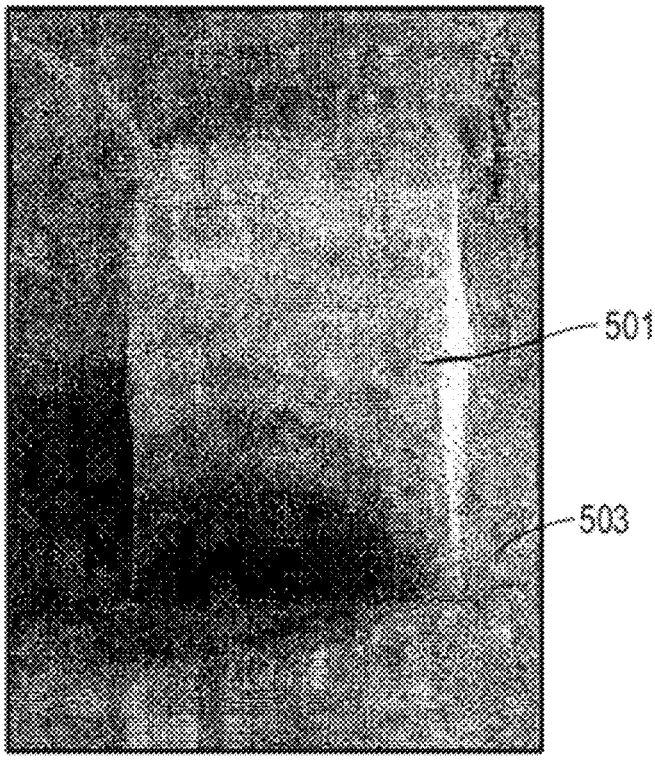
FIGS. 5 and 6 each show a scanning electron microscope (SEM) image of carbon nanotube (CNT) abrasive structures grown on a substrate, in accordance with an embodiment.

FIG. 5 illustrates a scanning electron microscope (SEM) picture of a three dimensional structure 501 consisting of carbon nanotubes, overlying a substrate 503, and prior to the formation of a bonding layer and any reinforcing layer. The three dimensional structure 501 is formed according to the process of FIG. 1, including the use of a catalyst layer. As illustrated, the three dimensional structure 501 has a generally square cross-sectional shape having an average width of 250 microns.

Figure 6:
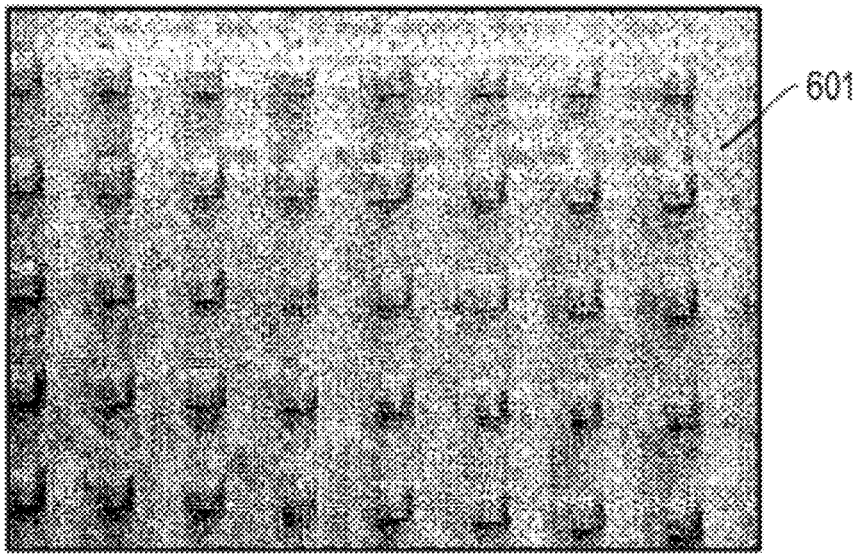

FIG. 6 illustrates an SEM picture of a plurality of three dimensional structures consisting of carbon nanotubes, overlying a substrate 601, and prior to the formation of a bonding layer and any reinforcing layer overlying the three dimensional structures. The three dimensional structures are formed according to the process of FIG. 1. As illustrated, the three dimensional structures are substantially uniform in size having a square cross-sectional shape and an average width of about 250 microns. Moreover, the three dimensional structures are arranged in an ordered array such that there is a generally consistent spacing between the three dimensional structures of approximately 400 microns.

Example

A silicon substrate in the form of a disk and having a diameter of two inches has a major surface coated with a catalyst. The catalyst layer includes multiple thin films formed via electron beam evaporation. A first film in direct contact with the surface of the substrate includes iron and is 1 nm thick on average. A second film, made of alumina, is formed over the first film until the overall thickness is 10 nm. The catalyst layer is then patterned by applying a photoresist layer over the catalyst layer and using an image reversal photoresist to form catalyst layer portions having discrete size and shape on the surface of the substrate.

Three dimensional structures are then formed over the catalyst layer portions by depositing carbon using chemical vapor deposition (CVD) at atmospheric pressure. The CVD operation is carried out at a temperature of 750° C. using C2H4, H2, and Ar as reactant materials. The three dimensional structures are formed of carbon nanotubes that extend vertically from the catalyst layer portions away from the substrate surface at a rate of 100 microns/minute. The carbon nanotubes forming the three dimensional structure are MWCNT having an average diameter of 10 nm.

A bonding layer is then formed over the three dimensional structures, using a CVD operation. The bonding layer includes CVD grown diamond. The bonding layer has an average thickness of 2 microns and is a conformal coating substantially overlying the surfaces of the three dimensional structures and portions of the substrate.

A reinforcing layer made of tungsten is then formed over the bonding layer via an electroplating process. The tungsten reinforcing layer is a generally conformal coating overlying the bonding layer and having an average thickness of 180 microns.

The CMP pad conditioners described herein offer an improvement in terms of performance and durability over conventional conditioners. Certain embodiments of the presently disclosed conditioners incorporate a combination of features including, three dimensional structures incorporating nanomaterials, such as particular forms of carbon (e.g., diamond and nanotubes), having geometric contours, and used in combination with a bonding layer and a reinforcing layer. Exemplary methods of forming the pad conditioners provided herein facilitate improvements including, the formation of three dimensional structures, the configuration and contours of such structures, and even control of the crystal or grain orientation of certain materials within the three dimensional structures. Accordingly, the combination of features provided herein with respect to certain embodiments, among other advantages, reduce the unintentional randomness of three dimensional surface features, improve grain orientation and positioning, and reduce abrasive grain pop-out.

While the invention has been illustrated and described in the context of specific embodiments, it is not intended to be limited to the details shown, since various modifications and substitutions can be made without departing in any way from the scope. For example, additional or equivalent substitutes can be provided and additional or equivalent production steps can be employed. As such, further modifications and equivalents of the invention herein disclosed may occur to persons skilled in the art using no more than routine experimentation, and all such modifications and equivalents are believed to be within the scope of the invention as defined by the following claims.

What is claimed is:

1. A CMP pad conditioner comprising:

a substrate having a surface;

three dimensional structures protruding relative to the surface of the substrate, each three dimensional structure comprising CVD carbon-containing material selected from the group consisting of carbon nanotubes and diamond;

a bonding layer overlying the three dimensional structures and the surface of the substrate; and a reinforcing layer disposed within gaps between the three dimensional structures such that a portion of the bonding layer overlying the three dimensional structures is extending above the reinforcing layer.

2. The CMP pad conditioner of claim 1, wherein the three dimensional structures consist essentially of CVD diamond.

3. The CMP pad conditioner of claim 2, wherein the CVD diamond is polycrystalline CVD diamond.

4. The CMP pad conditioner of claim 3, wherein the polycrystalline CVD diamond comprises crystals having an average crystallite size within a range between about 10 nm and about 10 microns.

5. The CMP pad conditioner of claim 1, wherein the three dimensional structures consist essentially of carbon nanotubes.

6. The CMP pad conditioner of claim 5, wherein the carbon nanotubes have an average width of not greater than about 100 nm.

7. The CMP pad conditioner of claim 1, wherein the three dimensional structures are arranged in an ordered array.

8. The CMP pad conditioner of claim 1, wherein the three dimensional structures have at least one of:

a cubic shape including a height≧width, wherein the width is not less than about 1 micron;

a cylindrical contour including a height≧diameter, wherein the diameter is not less than about 1 micron; and a pyramidal contour including a height≧base width, wherein the base width is not less than about 1 micron.

9. The CMP pad conditioner of claim 1, wherein the bonding layer infiltrates the three dimensional structures to an average infiltration depth of not less than about 10 nm, and comprises a material having a Mohs hardness not less than about 7 and that is selected from the group of materials consisting of oxides, nitrides, borides, carbides, alumina, zirconia, silicon nitride, silicon carbide, tungsten carbide, cubic boron nitride, diamond, carbon, and diamond-like-carbon, and any combination thereof.

10. The CMP pad conditioner of claim 1, wherein the reinforcing layer comprises a material selected from the group of materials consisting of polymer, resins, acrylics, metals, and ceramics.

11. The CMP pad conditioner of claim 1, further comprising a buffer layer disposed between the substrate and the three dimensional structures.

12. The CMP pad conditioner of claim 11, wherein the buffer layer is compositionally graded to accommodate differences in lattice constants between the substrate and the three dimensional structures.

13. A method of forming a CMP pad conditioner comprising:

providing a substrate having a surface;

selectively depositing three dimensional structures using a thin-film deposition technique, each of the three dimensional structures comprising a carbon-containing material selected from the group consisting of carbon nanotubes and diamond and protruding relative to the surface of the substrate;

forming a bonding layer overlying the three dimensional structures and the surface of the substrate;

forming a reinforcing layer overlying the bonding layer; and etching the reinforcing layer such that the reinforcing layer fills gaps between the three dimensional structures and a portion of the bonding layer overlying the three dimensional structures is extending above the reinforcing layer.

14. The method of claim 13, wherein the thin-film deposition technique includes chemical vapor deposition (CVD).

15. The method of claim 13, wherein the three dimensional structures consist essentially of diamond.

16. The method of claim 13, wherein forming the three dimensional structures includes forming an array of three dimensional structures, and further comprises, forming a catalyst layer overlying the surface of the substrate;

patterning the catalyst layer; and removing portions of the catalyst layer to leave an array of catalyst layer portions.

17. The method of claim 16, wherein forming an array of three dimensional structures further includes depositing carbon over at least portions of the catalyst layer.

18. The method of claim 13, wherein the three dimensional structures consist essentially of carbon-nanotubes.

19. The method of claim 13, wherein forming the array of three dimensional structures further comprises:

forming a buffer layer overlying the substrate; and growing three dimensional structures overlying the buffer layer.

20. A CMP pad conditioner comprising:

a substrate having a surface;

three dimensional structures arranged in a pattern and protruding relative to the surface of the substrate, each three dimensional structure comprising carbon nanotubes;

a bonding layer overlying the three dimensional structures and the surface of the substrate; and a reinforcing layer disposed within gaps between the three dimensional structures.

* * * * *